US008574013B2

(12) United States Patent
Wang et al.

(10) Patent No.: US 8,574,013 B2
(45) Date of Patent: Nov. 5, 2013

(54) POWER PLUG HAVING SOLERING TAILS OF A CONTACT TERMINAL AND A SLEEVE TERMINAL PROJECTING OUTSIDE A BODY

(75) Inventors: Chin-Chou Wang, New Taipei (TW); Yu-Hung Su, New Taipei (TW)

(73) Assignee: Cheng UEI Precision Industry Co., Ltd., New Taipei (TW)

( * ) Notice: Subject to any disclaimer, the term of this patent is extended or adjusted under 35 U.S.C. 154(b) by 22 days.

(21) Appl. No.: 13/443,850

(22) Filed: Apr. 10, 2012

(65) Prior Publication Data

US 2013/0267128 A1 Oct. 10, 2013

(51) Int. Cl.
*H01R 24/00* (2011.01)

(52) U.S. Cl.
USPC ..... 439/675

(58) Field of Classification Search
USPC ..... 439/674–679, 63, 68
See application file for complete search history.

(56) References Cited

U.S. PATENT DOCUMENTS

| | | | | |
|---|---|---|---|---|
| 6,948,977 | B1 * | 9/2005 | Behrent | 439/581 |
| 7,108,514 | B2 * | 9/2006 | Chen et al. | 439/63 |
| 7,824,192 | B2 * | 11/2010 | Lin et al. | 439/79 |
| 7,938,678 | B1 * | 5/2011 | Lee et al. | 439/541.5 |
| 8,192,206 | B1 * | 6/2012 | Ju | 439/66 |
| 8,337,254 | B2 * | 12/2012 | Jin | 439/675 |
| 2011/0143603 | A1 * | 6/2011 | Huang et al. | 439/675 |

* cited by examiner

*Primary Examiner* — Chandrika Prasad
(74) *Attorney, Agent, or Firm* — Cheng-Ju Chiang

(57) ABSTRACT

A power plug includes a base body which has a mating pillar and two propping flanks oppositely extending outward from a bottom end of the mating pillar, an electrical terminal inserted downward in the mating pillar, a sleeve terminal having a contact sleeve put around the mating pillar, and a fastening member defining an assembling hole through which the mating pillar with the contact sleeve passes to make the fastening member abut on the propping flanks. Then the fastening member and the propping flanks are fixed together. A positioning gap forms at the joint of the propping flanks. The electrical terminal has a soldering plate projecting downward out of the bottom end of the mating pillar. A soldering tail protrudes downward from a bottom edge of the contact sleeve to be positioned in the positioning gap, with a bottom thereof projecting under the base body.

6 Claims, 7 Drawing Sheets

POWER PLUG HAVING SOLERING TAILS OF A CONTACT TERMINAL AND A SLEEVE TERMINAL PROJECTING OUTSIDE A BODY

BACKGROUND OF THE INVENTION

1. Field of the Invention

The present invention relates to a plug, and more particularly to a power plug.

2. The Related Art

Referring to FIG. 1 and FIG. 2, a conventional power plug 20' is shown. The power plug 20' includes a base body 21', an electrical terminal 22' inserted in the base body 21', a restraining block 24' inserted in the base body 21' to secure the electrical terminal 22' in the base body 21', a fastening member 23' and a metal sleeve 25'. The base body 21' has one end thereof designed as a blocking pedestal 211' which is wider than other parts of the base body 21' in diameter. The electrical terminal 22' has a soldering plate 221' in which a soldering hole 222' is opened. The fastening member 23' has a holding ring 231', a U-shaped clamping portion 232' and an oblong connecting plate 233' which connects one side of the holding ring 231' with a bend of the clamping portion 232'. The other end of the base body 21' passes through the holding ring 231' of the fastening member 23', and then is inserted in the metal sleeve 25' to firmly clip the holding ring 231' between the blocking pedestal 211' and the metal sleeve 25'.

When the power plug 20' is connected with a cable 1', a core wire of the cable 1' is wound around the soldering plate 221' through the soldering hole 222', and then is soldered with the soldering plate 221'. Next, bend the connecting plate 23' towards the cable 1' to make the clamping portion 232' clamp the cable 1' therein so as to secure the cable 1' and the power plug 20' together. At this time, the connecting plate 23' is substantially perpendicular to the holding ring 231'. Last, mold a protective sleeve (not shown) around the fastening member 23' and the cable 1'. However, for the conventional power plug 20', the connecting plate 233' badly deviates from the axis B' of the cable 1' and the holding ring 231'. When molding the protective sleeve around the fastening member 23' and the cable 1', the cable 1', the connecting plate 233' or the clamping portion 232' is easily exposed partly if the power plug 20' wants to have a small volume of the protective sleeve. In order to completely envelop the cable 1', the connecting plate 233' and the clamping portion 232', the protective sleeve must be molded to be large enough. As a result, it increases manufacture difficulty and production cost.

SUMMARY OF THE INVENTION

Accordingly, an object of the present invention is to provide a power plug including a base body, an electrical terminal, a sleeve terminal and a fastening member. The base body has a columned mating pillar placed vertically. A bottom end of the mating pillar oppositely extends outward along a radial direction of the mating pillar to form a pair of propping flanks. A positioning gap forms at the joint of the pair of propping flanks. The electrical terminal is inserted downward in the mating pillar of the base body, and has a soldering plate which penetrates through the bottom end of the mating pillar to partly project out of the base body. The sleeve terminal has a cylindraceous contact sleeve put around the mating pillar of the base body. A soldering tail protrudes downward from a bottom edge of the contact sleeve to be partly positioned in the positioning gap. A bottom of the soldering tail further projects under the base body. The fastening member is of a flat board shape and defines an assembling hole through which the mating pillar of the base body together with the contact sleeve passes to make the fastening member abut on the propping flanks. Then the fastening member and the propping flanks are fixed together to further secure the sleeve terminal and the base body together.

As described above, the mating pillar and the propping flanks of the base body, the contact sleeve and the soldering tail of the sleeve terminal, and the fastening member are designed to simplify the structure and the assembly process of the power plug, miniaturize the power plug and further reduce production cost.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 4:
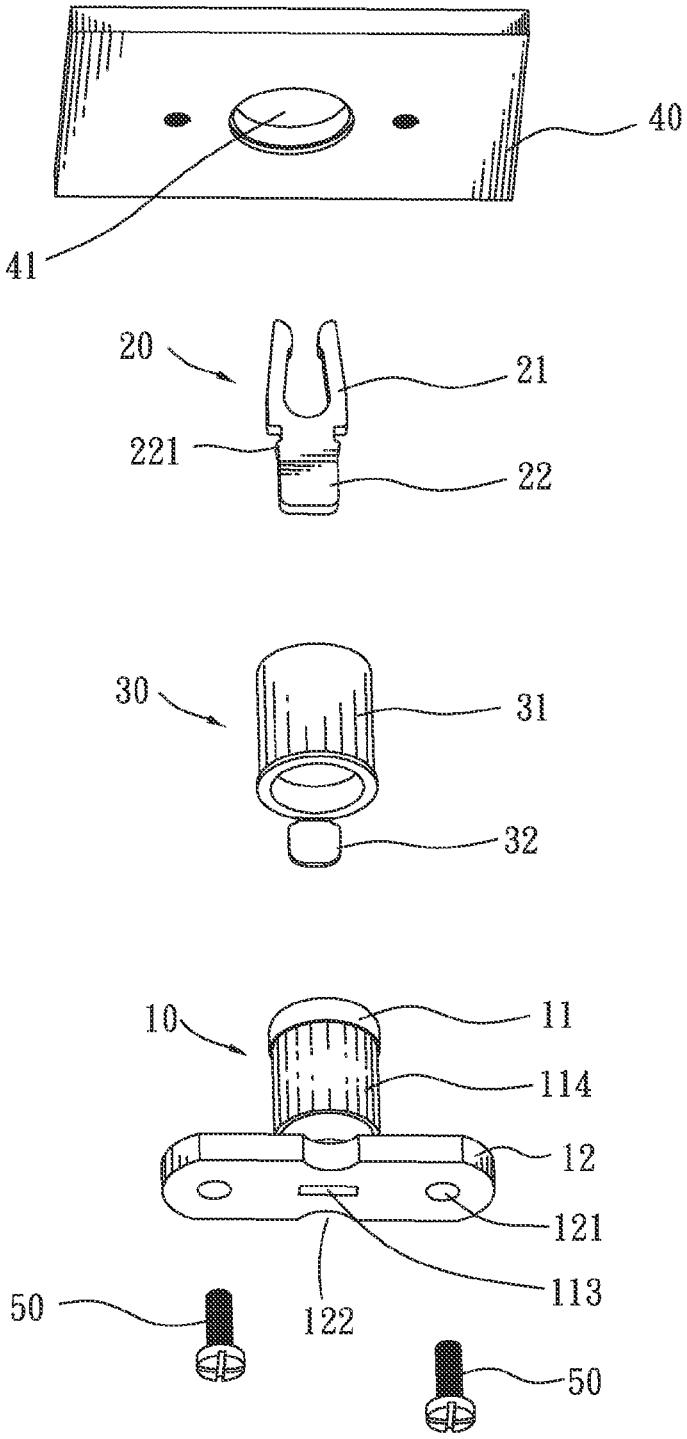
FIG. 4 is an exploded perspective view of the power plug of FIG. 3.
Figure 5:
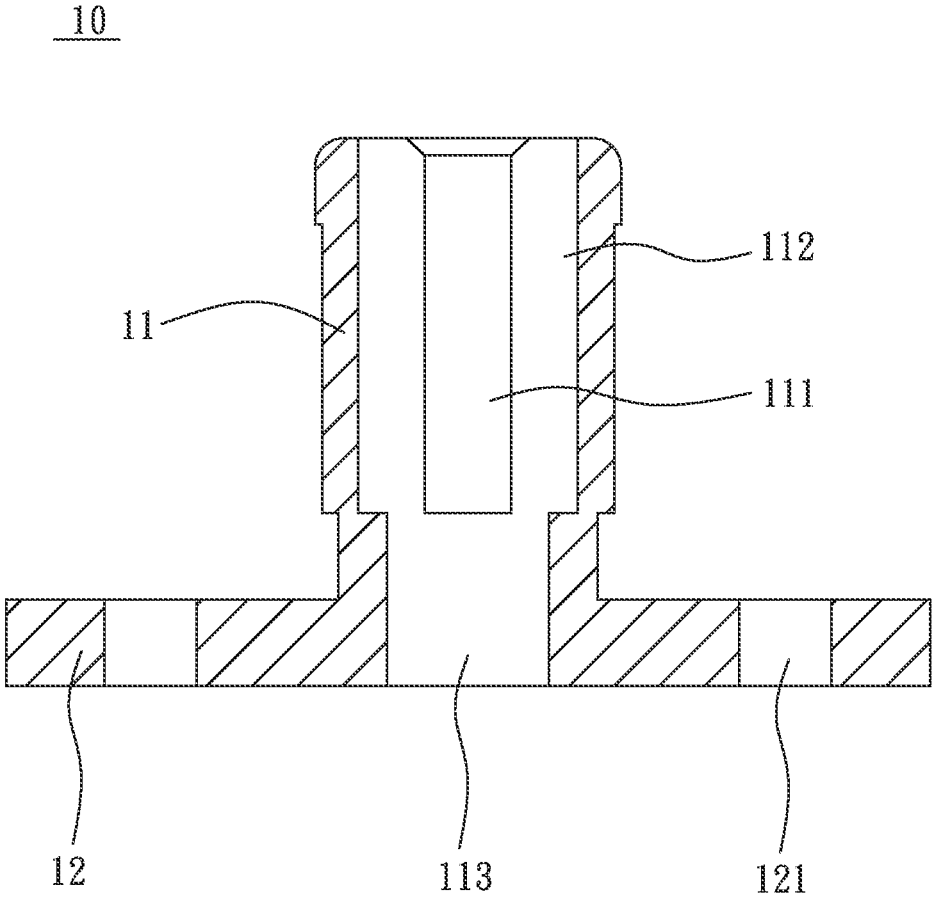
FIG. 5 is a cross-sectional view of a base body of the power plug of FIG. 4.
Figure 6:
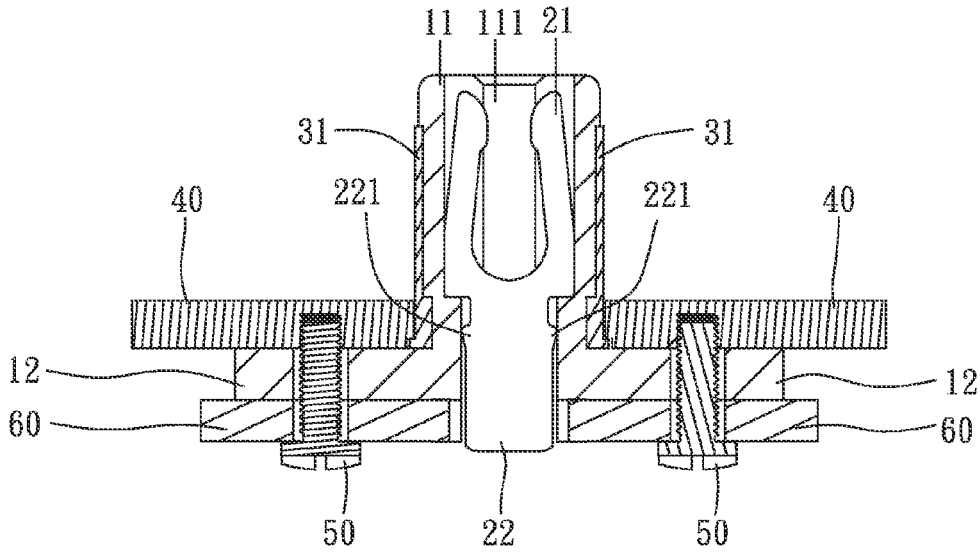
FIG. 6 is a sectional view showing that the power plug is connected with a circuit board.
Figure 7:
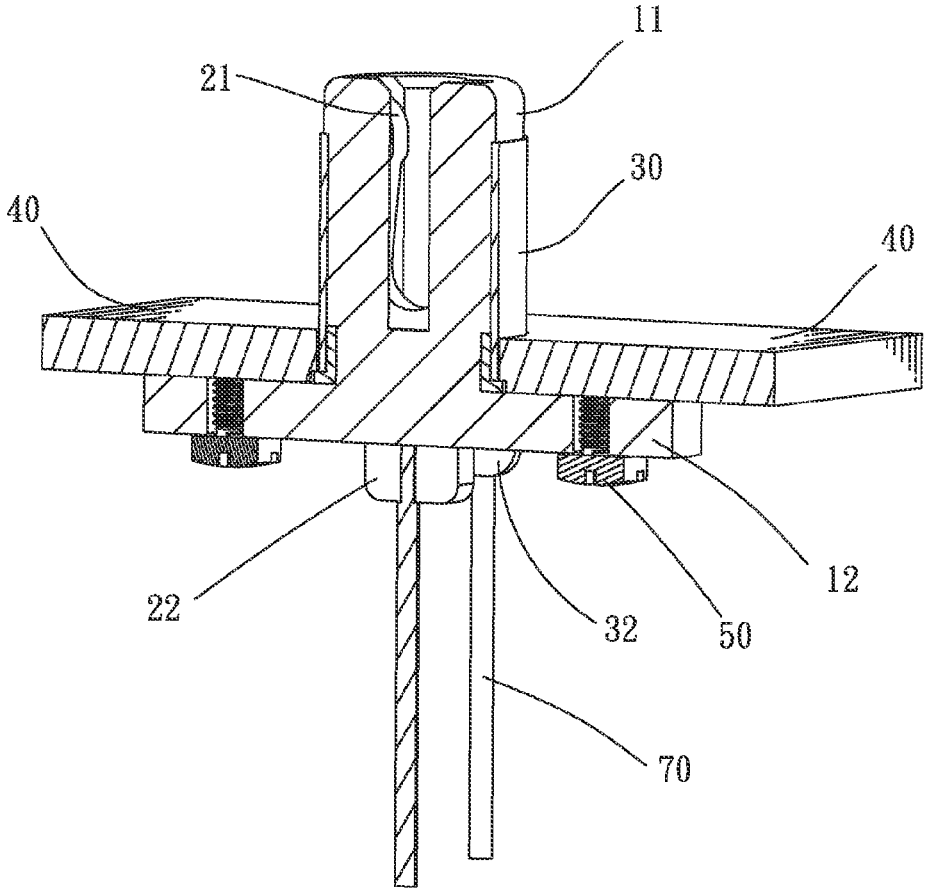
FIG. 7 is a sectional view showing that the power plug is connected with a cable.

Referring to FIG. 4, FIG. 6 and FIG. 7, a power plug according to an embodiment of the present invention is adapted for connecting with a circuit board 60 by means of a SMT process or a cable 70. The power plug includes a base body 10, an electrical terminal 20, a sleeve terminal 30 and a fastening member 40.

Figure 1:
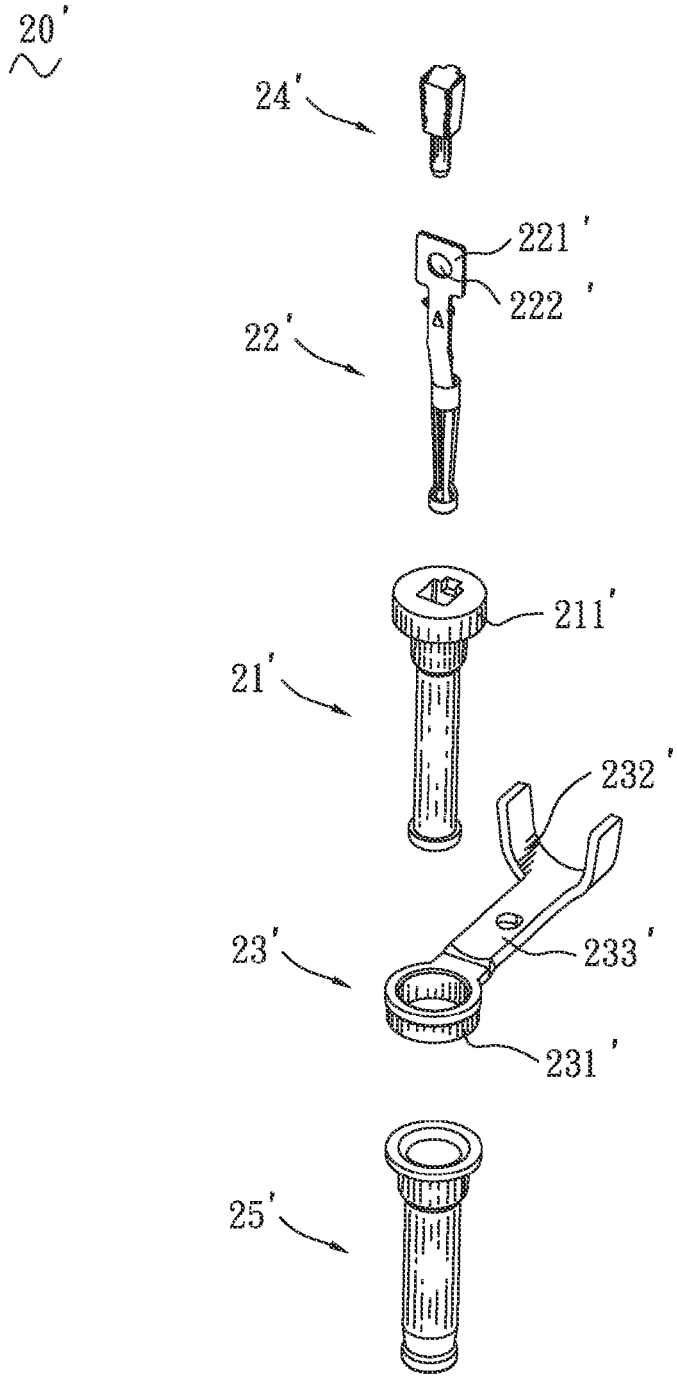
FIG. 1 (Prior Art)
FIG. 1 is an exploded perspective view of a conventional power plug.
Figure 2:
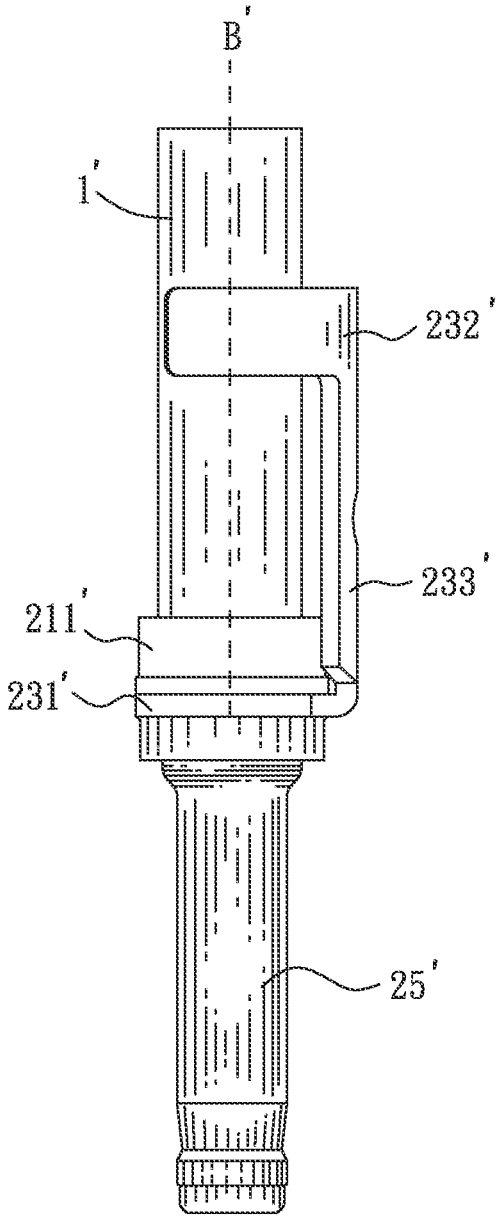
FIG. 2 (Prior Art)
FIG. 2 is a using state view of the conventional power plug of FIG. 1.
Figure 3:
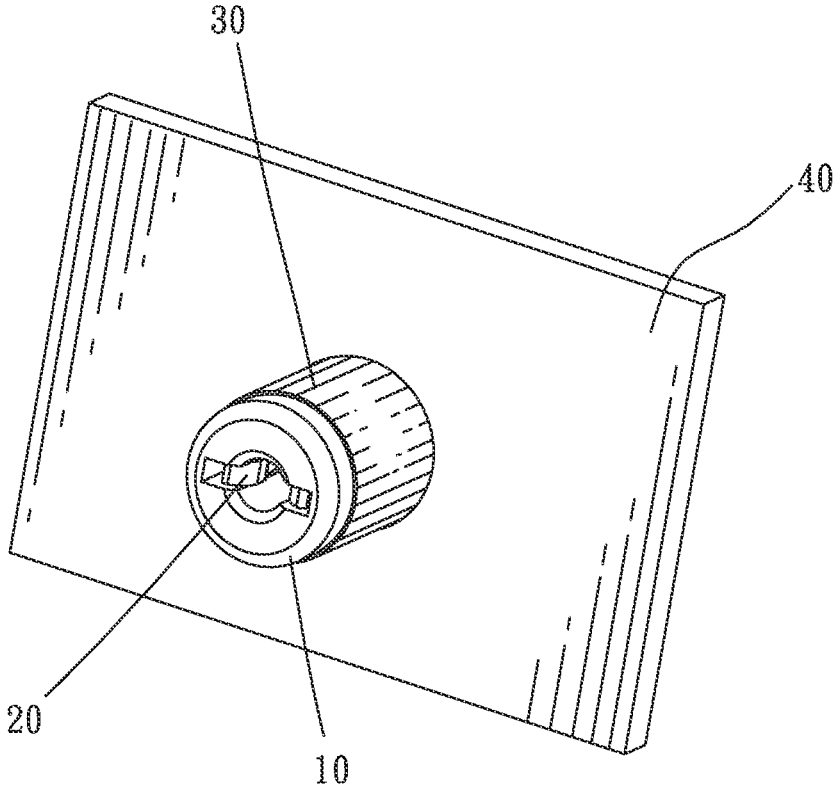
FIG. 3 is an assembled perspective view of a power plug according to an embodiment of the present invention.

With reference to FIG. 3, FIG. 4 and FIG. 7, the base body 10 has a columned mating pillar 11 placed vertically. A bottom end of the mating pillar 11 oppositely extends outward along a radial direction of the mating pillar 11 to form a pair of propping flanks 12. A positioning gap 122 forms at the joint of the pair of propping flanks 12. The electrical terminal 20 is inserted downward in the mating pillar 11 of the base body 10. The electrical terminal 20 has a soldering plate 22 which penetrates through the bottom end of the mating pillar 11 to partly project out of the base body 10. The sleeve terminal 30 has a cylindraceous contact sleeve 31 put around the mating pillar 11 of the base body 10. A soldering tail 32 protrudes downward from a bottom edge of the contact sleeve 31 to be partly positioned in the positioning gap 122. A bottom of the soldering tail 32 further projects under the base body 10. The fastening member 40 is of a flat board shape and defines an assembling hole 41 through which the mating pillar 11 of the base body 10 together with the contact sleeve 31 passes to make the fastening member 40 abut on the propping flanks 12. Then the fastening member 40 and the propping flanks 12 are fixed together to further secure the sleeve terminal 30 and the base body 10 together.

Referring to FIG. 4 and FIG. 7, each propping flank 12 of the base body 10 defines at least one fastening aperture 121 vertically penetrating therethrough. The power plug further includes at least two fastening elements 50 passing upward through the respective fastening apertures 121 to fix the fastening member 40 and the propping flanks 12 together. In this embodiment, the fastening element 50 is a screw.

Referring to FIGS. 3-6, the mating pillar 11 of the base body 10 defines a mating hole 111 and a pair of receiving fillisters 112 of which each extends vertically to penetrate through a top of the mating pillar 11. The receiving fillisters 112 are located at two sides of the mating hole 111 along a radial direction of the mating hole 111 and communicated with the mating hole 111. Bottoms of the receiving fillisters 112 are connected together and then penetrate downward through the bottom end of the mating pillar 11 to form a rectangular through slot 113. The soldering plate 22 of the electrical terminal 20 is substantially of rectangular shape and inserted downward in the through slot 113. Two ends of a top edge of the soldering plate 22 extend upward and are inclined towards each other to form a pair of contact arms 21 located in the receiving fillisters 112. Top ends of the contact arms 21 elastically project into the mating hole 111. Two side edges of the soldering plate 22 protrude outward to form a plurality of barbs 221 resisting against inner sides of the through slot 113. An outer periphery of the mating pillar 11 of the base body 10 is concaved inward to form a cylindraceous restraining groove 114 for restraining the contact sleeve 31 of the sleeve terminal 30 therein.

Referring to FIG. 6 again, when the power plug is connected with the circuit board 60 by the SMT process, the circuit board 60 abuts under the base body 10 with the bottoms of the soldering plate 22 of the electrical terminal 20 and the soldering tail 32 of the sleeve terminal 30 being inserted in the circuit board 60 and soldered with the circuit board 60. The fastening elements 50 successively pass through the circuit board 60 and the corresponding fastening apertures 121 of the propping flanks 12 to fasten the circuit board 60 and the power plug together.

Referring to FIG. 7 again, when the power plug is connected with the circuit board 60 by the cable 70, core wires of one end of the cable 70 are soldered with the soldering plate 22 of the electrical terminal 20 and the soldering tail 32 of the sleeve terminal 30 respectively, and the other end of the cable 70 is soldered with the circuit board 60. So an electrical connection between the power plug and the circuit board 60 is realized by the cable 70.

As described above, the mating pillar 11 and the propping flanks 12 of the base body 10, the contact sleeve 31 and the soldering tail 32 of the sleeve terminal 30, and the fastening member 40 are designed to simplify the structure and the assembly process of the power plug, miniaturize the power plug and further reduce production cost.

What is claimed is:

1. A power plug, comprising:

a base body having a columned mating pillar placed vertically, a bottom end of the mating pillar oppositely extending outward along a radial direction of the mating pillar to form a pair of propping flanks, a positioning gap forming at the joint of the pair of propping flanks;

an electrical terminal inserted downward in the mating pillar of the base body, the electrical terminal having a soldering plate which penetrates through the bottom end of the mating pillar to partly project out of the base body;

a sleeve terminal having a cylindraceous contact sleeve put around the mating pillar of the base body, a soldering tail protruding downward from a bottom edge of the contact sleeve to be partly positioned in the positioning gap, a bottom of the soldering tail further projecting under the base body; and a fastening member of flat board shape defining an assembling hole through which the mating pillar of the base body together with the contact sleeve passes to make the fastening member abut on the propping flanks, then the fastening member and the propping flanks being fixed together to further secure the sleeve terminal and the base body together.

2. The power plug as claimed in claim 1, wherein each propping flank of the base body defines at least one fastening aperture vertically penetrating therethrough, the power plug further includes at least two fastening elements passing upward through the respective fastening apertures to fix the fastening member and the propping flanks together.

3. The power plug as claimed in claim 2, wherein the fastening element is a screw.

4. The power plug as claimed in claim 1, wherein the mating pillar of the base body defines a mating hole and a pair of receiving fillisters of which each extends vertically to penetrate through a top of the mating pillar, the receiving fillisters are located at two sides of the mating hole along a radial direction of the mating hole and communicated with the mating hole, bottoms of the receiving fillisters are connected together and then penetrate downward through the bottom end of the mating pillar to form a rectangular through slot, the soldering plate of the electrical terminal is substantially of rectangular shape and inserted downward in the through slot, two ends of a top edge of the soldering plate extend upward and are inclined towards each other to form a pair of contact arms located in the receiving fillisters, top ends of the contact arms elastically project into the mating hole.

5. The power plug as claimed in claim 4, wherein two side edges of the soldering plate protrude outward to form a plurality of barbs resisting against inner sides of the through slot.

6. The power plug as claimed in claim 1, wherein an outer periphery of the mating pillar of the base body is concaved inward to form a cylindraceous restraining groove for restraining the contact sleeve of the sleeve terminal therein.

* * * * *